US009069320B2

(12) United States Patent
Ushikubo

(10) Patent No.: US 9,069,320 B2
(45) Date of Patent: Jun. 30, 2015

(54) CLEANING DEVICE, IMAGE FORMING UNIT AND IMAGE FORMING APPARATUS

(71) Applicant: Oki Data Corporation, Tokyo (JP)

(72) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/077,919

(22) Filed: Nov. 12, 2013

(65) Prior Publication Data

US 2014/0133893 A1 May 15, 2014

(30) Foreign Application Priority Data

Nov. 13, 2012 (JP) ..... 2012-249117

(51) Int. Cl.
*G03G 21/00* (2006.01)

(52) U.S. Cl.
CPC ..... *G03G 21/0029* (2013.01)

(58) Field of Classification Search
USPC ..... 399/350, 343, 357, 351
See application file for complete search history.

(56) References Cited

U.S. PATENT DOCUMENTS 5,991,570 A * 11/1999 Haga et al. ..... 399/114
8,103,185 B2 * 1/2012 Chiba et al. ..... 399/101
8,676,108 B2 * 3/2014 Hasegawa et al. ..... 399/346
2006/0133837 A1 * 6/2006 Shimojo et al. ..... 399/71
2009/0297206 A1 * 12/2009 Fujishiro et al. ..... 399/100
2012/0014710 A1 * 1/2012 Kobayashi et al. ..... 399/101
2013/0336694 A1 * 12/2013 Kadota et al. ..... 399/349

FOREIGN PATENT DOCUMENTS

JP H05-319539 A 12/1993
JP H11-161133 A 6/1999
JP 2004-317977 A 11/2004
JP 2006-058729 A 3/2006
JP 2007-101751 A 4/2007
JP 2011-150319 A 8/2011

* cited by examiner

*Primary Examiner* — Rochelle-Ann J Blackman
*Assistant Examiner* — Linda B Smith
(74) *Attorney, Agent, or Firm* — Muncy, Geissler, Olds & Lowe, P.C.

(57) ABSTRACT

A cleaning device for an image forming apparatus includes a cleaning member that removes residual developer that remains on a image carrier, a rotary conveying member that conveys the removed residual developer toward a predetermined direction, and a housing that contains the rotary conveying member. The housing includes a support member that supports the cleaning member; and a protective member that has an inner wall which opposes outer periphery of the rotary conveying member and partially covers the rotary conveying member. The protective member is made of a resin molding material to which a filler is not added.

17 Claims, 7 Drawing Sheets

CLEANING DEVICE, IMAGE FORMING UNIT AND IMAGE FORMING APPARATUS

CROSS REFERENCE TO RELATED APPLICATION

The present application is related to, claims priority from and incorporates by reference Japanese Patent Application No. 2012-249117, filed on Nov. 13, 2012.

TECHNICAL FIELD

The present invention relates to a cleaning device that removes developer from an image carrier carrying a developer image formed by an image forming process of an electrophotographic method, an image forming unit that has the cleaning device, and an image forming apparatus that is provided with the image forming unit.

BACKGROUND

The image forming process of the electrophotographic method is widely used, for example, in an image forming apparatus such as a copier, a facsimile device and a printer. An image forming apparatus that operates using the electrophotographic method executes a series of processes such as a charging process uniformly charging a surface of an image carrier such as a photoreceptor, an exposure process irradiating the surface of the image carrier with light to form an electrostatic latent image, a developing process attaching the charged developer to the electrostatic latent image to form a developer image on the image carrier, a transfer process transferring the developer image to a recording medium such as a sheet, and a fusing process fusing the transferred developer image onto the recording medium.

However, in the transfer process, it is difficult for the entire developer image to be transferred from the image carrier to the recording medium so that it is possible for developer to remain on the image carrier. Therefore, in the image forming apparatus, a cleaning device is incorporated that removes, from the image carrier, the unwanted developer (or residual developer) remained after the transfer process. A cleaning device of this kind is disclosed, for example, in Japanese Patent Laid-Open Publication No. 2006-58729 (Patent Document 1).

For the above-described conventional cleaning device, there is a problem that noise is generated.

In view of the above-described problem, a purpose of the present invention is to provide a cleaning device, an image forming unit and an image forming apparatus that are able to suppress noise generation.

SUMMARY

A cleaning device incorporated in an image forming apparatus is disclosed. The image forming apparatus includes an image carrier and a transfer member, the image carrier carrying a developer image formed by an electrophotographic method, the transfer member transferring the developer image from the image carrier to a medium. The cleaning device includes a cleaning member that removes, from the image carrier, residual developer that remains on the image carrier without being transferred from the image carrier to the medium, a rotary conveying member that has a rotation axis in a predetermined direction, rotates about the rotation axis, and conveys the removed residual developer toward the predetermined direction, and a housing that contains the rotary conveying member. The housing includes a support member that supports the cleaning member, and a protective member that has an inner wall which opposes outer periphery of the rotary conveying member and partially covers the rotary conveying member. The protective member is made of a resin molding material to which a filler is not added. In the invention, the medium includes an intermediate transfer member as well as a recording medium.

According to the present invention, the housing that contains the rotary conveying member includes the support member that supports the cleaning member and the protective member that covers the rotary conveying member. The rigidity of the protective member is lower than the rigidity of the support member. Therefore, even when the rotating rotary conveying member rubs against the protective member, noise generation can be prevented. In addition, the support member has a rigidity higher than that of the protective member and thus can stably support the cleaning member.

DETAILED DESCRIPTION

In the following, various embodiments according to the present invention are described with reference to the drawings.

First Embodiment

Figure 1:
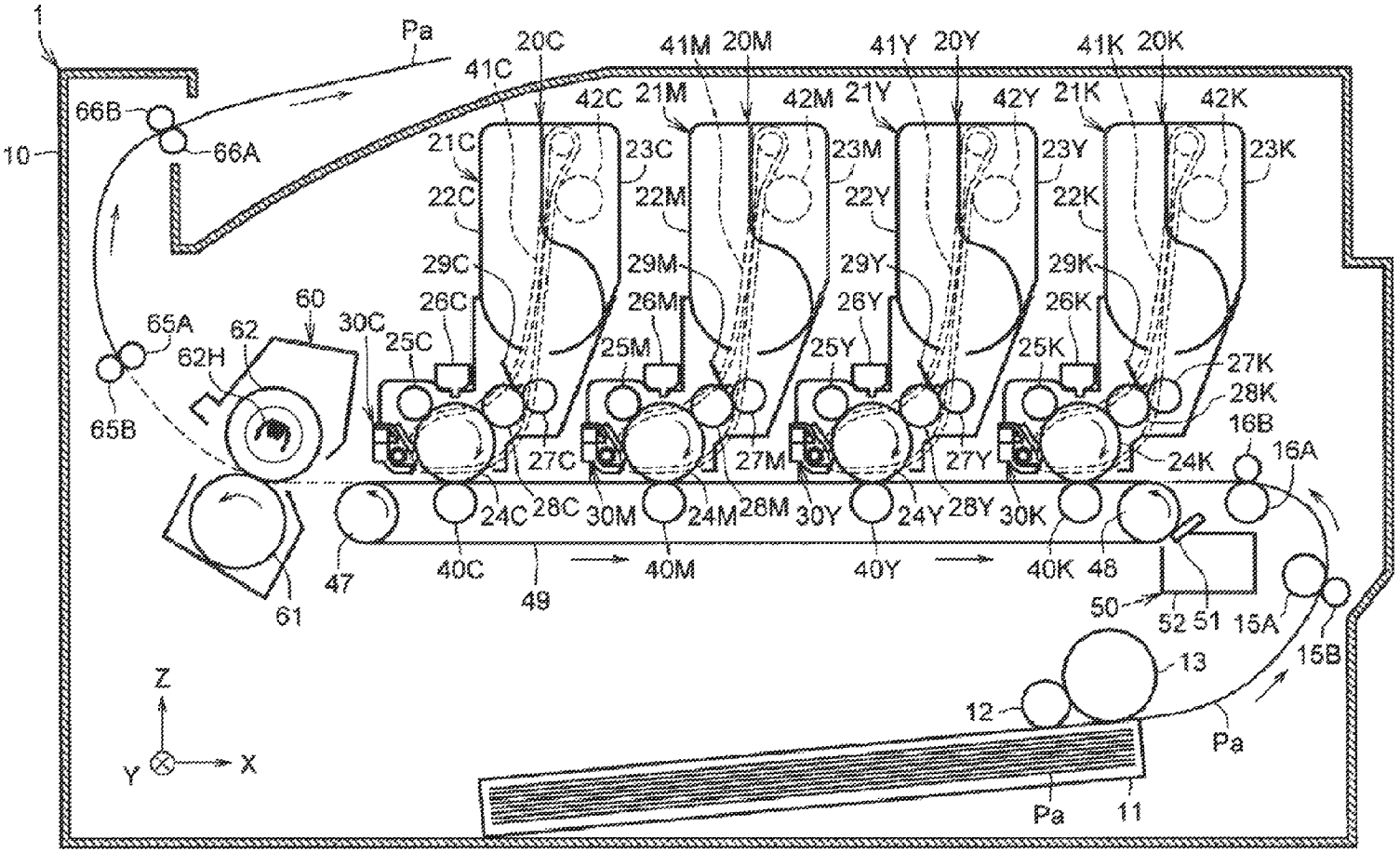
FIG. 1 schematically illustrates a configuration of an image forming apparatus of a first embodiment according to the present invention.

FIG. 1 schematically illustrates a configuration of an image forming apparatus 1 of a first embodiment according to the present invention. As illustrated in FIG. 1, the image forming apparatus 1 includes, in a casing 10, image forming units 20K, 20Y, 20M, 20C respectively generating developer images of black (K), yellow (Y), magenta (M) and cyan (C); a tray 11 containing a recording medium Pa that is a transferred material; a roller 12 retrieving the recording medium Pa from the tray 11; a hopping roller 13 sending out one sheet at a time the recording medium Pa retrieved from the tray 11; conveying rollers 15A, 15B, 16A, 16B conveying toward the image forming unit 20K the recording medium Pa sent out by the hopping roller 13; a transfer belt 49 carrying thereon and conveying the recording medium Pa; transfer rollers 40K, 40Y, 40M, 40C transferring the developer images formed by the image forming units 20K, 20Y, 20M, 20C to the recording medium Pa; and a fuser unit 60.

Further, the image forming apparatus 1 includes driving rollers 47, 48 driving the transfer belt 49. The transfer belt 49 is an endless elastic belt stretched between outer peripheries of the driving rollers 47, 48. An example of a constituent material of the transfer belt 49 is polyurethane rubber. The driving rollers 47, 48 can cyclically move the transfer belt 49 by rotating counterclockwise.

The tray 11 has a function of containing a plurality of sheets of the recording medium Pa in a stacked state and is detachably attached to a frame of the image forming apparatus 1. Examples of the recording medium Pa include sheet-like media such as sheets, plastic film, synthetic paper or fabric.

The image forming units 20K, 20Y, 20M, 20C are arranged in a row above the transfer belt 49 along a conveying direction of the recording medium Pa (−X-axis direction). Therefore, the recording medium Pa on the transfer belt 49 passes through immediately below the image forming units 20K, 20Y, 20M, 20C in this order. The transfer rollers 40K, 40Y, 40M, 40C are respectively arranged at positions opposing the image forming units 20K, 20Y, 20M, 20C across the transfer belt 49.

The image forming unit 20K that forms a black developer image has a developer cartridge 21K, a photoreceptor drum 24K, a charging roller 25K, an LED head 26K, a supply roller 27K, a developing roller 28K and a layer forming blade 29K. The developer cartridge 21K is detachably attached to a main body part of the image forming unit 20K. The developer cartridge 21K includes a developer containing part 22K containing unused black developer, and a waste developer containing part 23K containing residual developer that, as will be described later, is recovered without being transferred to the recording medium Pa. The developer containing part 22K can supply developer from a supply port formed in a lower portion thereof to the supply roller 27K.

As the developer, for example, pulverized toner manufactured using a pulverization method can be used. A manufacturing process of the pulverized toner includes, for example, a process of generating a melt-kneaded product by melt-kneading and cooling a toner raw material made of a binder resin, a coloring agent, a release agent, a charge control agent and the like; a process of generating toner base particles having an average particle size of a few μm by pulverizing and classifying the melt-kneaded product; and a process of generating a nonmagnetic one-component developer by adding an external additive such as hydrophobic silica to the toner base particles. As the binder resin, for example, a polyester resin having a glass transition temperature of about 40° C. can be used.

The photoreceptor drum 24K as an image carrier has a tubular shape with a Y-axis direction in FIG. 1 (direction perpendicular to a plane of the drawing) as a longitudinal direction, and is configured, for example, by a metal pipe (conductive substrate) of aluminum and the like and a photoconductive layer of an organic photoreceptor or the like formed around the metal pipe. During operation of the image forming apparatus 1, the photoreceptor drum 24K rotates clockwise at a predetermined speed about a rotation axis. The charging roller 25K is in contact with a surface of the photoreceptor drum 24K and uniformly charges the entire surface of the photoreceptor drum 24K.

The LED head 26K as an exposure part irradiates the surface of the rotating photoreceptor drum 24K with pattern light corresponding to a print image and forms an electrostatic latent image. The LED head 26K is configured with, for example, a large number of LED elements (light-emitting diode elements) arranged in the Y-axis direction along the surface of the photoreceptor drum 24K, an LED drive circuit driving the LED elements, and a lens array guiding the emitting light of the LED elements to the surface of the photoreceptor drum 24K.

The supply roller 27K as a developer supply member has a tubular shape with the Y-axis direction as a longitudinal direction and rotates about its own central axis. The supply roller 27K carries developer supplied from the developer containing part 22K on its surface and supplies the developer to the developing roller 28K. The developing roller 28K has a tubular shape with the Y-axis direction as a longitudinal direction, and rotates counterclockwise about its own central axis and conveys the developer attached to its surface. The layer forming blade 29K causes the developer on the developing roller 28K to be formed into a thin layer. When a portion of the surface of the photoreceptor drum 24K where an electrostatic latent image is formed reaches the developing roller 28K, due to a potential difference between the electrostatic latent image and the developing roller 28K, developer moves from the developing roller 28K to the photoreceptor drum 24K and forms a developer image on the photoreceptor drum 24K. Thereafter, the transfer roller 40K as a transfer member transfers the developer image on the photoreceptor drum 24K to the recording medium Pa nipped (sandwiched) between the transfer roller 40K and the photoreceptor drum 24K. In this case, a transfer bias (voltage) is applied to the transfer roller 40K. Therefore, under the action of the electrostatic force, the developer image can be transferred from the photoreceptor drum 24K to the recording medium Pa.

The configuration of each of the other image forming units 20Y, 20M, 20C other than the developer is the same as the configuration of the image forming unit 20K that forms a black (K) developer image. The image forming unit 20Y that forms a yellow (Y) developer image has a developer cartridge 21Y, a photoreceptor drum (image carrier) 24Y, a charging roller 25Y, an LED head (exposure part) 26Y, a supply roller 27Y, a developing roller (developer carrier) 28Y and a layer forming blade 29Y. The developer cartridge 21Y includes a developer containing part 22Y containing unused yellow developer, and a waste developer containing part 23Y containing residual developer that is recovered without being transferred to the recording medium Pa. The recording medium Pa supplied from the image forming unit 20K on an upstream side is nipped (sandwiched) between the photoreceptor drum 24Y and the transfer roller 40Y of the image forming unit 20Y. The transfer roller (transfer member) 40Y transfers a yellow developer image on the photoreceptor drum 24Y to the recording medium Pa.

The image forming unit 20M that forms a magenta (M) developer image has a developer cartridge 21M, a photoreceptor drum (image carrier) 24M, a charging roller 25M, an LED head (exposure part) 26M, a supply roller 27M, a developing roller (developer carrier) 28M and a layer forming blade 29M. The developer cartridge 21M includes a developer containing part 22M containing unused magenta developer, and a waste developer containing part 23M containing residual developer that is recovered without being transferred to the recording medium Pa. The recording medium Pa supplied from the image forming unit 20Y on an upstream side is nipped (sandwiched) between the photoreceptor drum 24M and the transfer roller 40M of the image forming unit 20M. The transfer roller (transfer member) 40M transfers a magenta developer image on the photoreceptor drum 24M to the recording medium Pa.

The image forming unit 20C that forms a cyan (C) developer image has a developer cartridge 21C, a photoreceptor drum (image carrier) 24C, a charging roller 25C, an LED head (exposure part) 26C, a supply roller 27C, a developing roller (developer carrier) 28C and a layer forming blade 29C. The developer cartridge 21C includes a developer containing part 22C containing unused cyan developer, and a waste developer containing part 23C containing residual developer that is recovered without being transferred to the recording medium Pa. The recording medium Pa supplied from the image forming unit 20M on an upstream side is nipped (sandwiched) between the photoreceptor drum 24C and the transfer roller 40C of the image forming unit 20C. The transfer roller (transfer member) 40C transfers a cyan developer image on the photoreceptor drum 24C to the recording medium Pa.

After a developer image of four colors is transferred to the recording medium Pa in the above image forming units 20K, 20Y, 20M, 20C, the recording medium Pa is conveyed to the fuser unit 60. The fuser unit 60 has a function of fusing the developer image and fixing the developer image onto the recording medium Pa by applying pressure and heat to the developer image transferred to the recording medium Pa. As illustrated in FIG. 1, the fuser unit 60 has a fusing roller 62 of a circular pipe shape, and a pressing roller 61 having a surface layer made of an elastic material. A fuser unit heater (heat source) 62H such as a halogen lamp is arranged inside the fusing roller 62.

The recording medium Pa sent out from the fuser unit 60 is supplied to a pair of conveying rollers 65A, 65B. The conveying rollers 65A, 65B sandwich the recording medium Pa and supply the recording medium Pa to a pair of eject rollers 66A, 66B. The eject rollers 66A, 66B sandwich the recording medium Pa conveyed thereto and eject the recording medium Pa outside.

When print image data is input from an external device to the image forming apparatus 1, in response to the input of the print image data, a controller (not illustrated in the drawings) starts a printing operation of the image forming apparatus 1. Specifically, the controller causes the photoreceptor drums 24K, 24Y, 24M, 24C of the above image forming units 20K, 20Y, 20M, 20C, the charging rollers 25K, 25Y, 25M, 25C, the transfer belt 49 and the developing rollers 28K, 28Y, 28M, 28C to respectively rotate. At the same time, the controller separately applies a bias voltage from a power circuit (not illustrated in the drawings) to each of the charging rollers 25K, 25Y, 25M, 25C, the developing rollers 28K, 28Y, 28M, 28C, the supply rollers 27K, 27Y, 27M, 27C, the layer forming blades 29K, 29Y, 29M, 29C and the transfer rollers 40K, 40Y, 40M, 40C. Further, the controller causes the pressing roller 61 and the fusing roller 62 inside the fuser unit 60 to rotate, and supplies power to the fuser unit heater 62H to adjust temperature of the fusing roller 62.

Thereafter, in accordance with the timing at which the recording medium Pa reaches the image forming units 20K, 20Y, 20M, 20C, the controller drives the LED heads 26K, 26Y, 26M, 26C and respectively irradiates the photoreceptor drums 24K, 24Y, 24M, 24C with pattern light corresponding to a print image from the LED heads 26K, 26Y, 26M, 26C. As a result, electrostatic latent images are respectively sequentially formed on the surfaces of the photoreceptor drums 24K, 24Y, 24M, 24C. As described above, charged K, Y, M and C developers are respectively attached to the electrostatic latent images on the photoreceptor drums 24K, 24Y, 24M, 24C by electrostatic forces to form developer images. The developer images of the four colors are transferred to the recording medium Pa and are superimposed. Thereby, a color developer image is formed on the recording medium Pa.

The fuser unit 60 fixes the color developer image on the recording medium Pa conveyed thereto onto the recording medium Pa. Thereafter, the recording medium Pa is ejected outside the image forming apparatus 1 by the conveying rollers 65A, 65B and the eject rollers 66A, 66B.

Developer attached to a surface of the transfer belt 49 without being transferred to the recording medium Pa is recovered by a belt cleaning device 50 illustrated in FIG. 1. The belt cleaning device 50 includes a cleaning blade 51 scraping off the developer from the surface of the transfer belt 49 and a waste developer recovery container 52 containing the developer scraped off. The cleaning blade 51 has an edge portion made of an elastic material. By bringing the edge portion into contact with the transfer belt 49, the developer can be scraped off from the transfer belt 49.

In the image forming units 20K, 20Y, 20M, 20C, after the developer images are respectively transferred to the recording medium Pa, there may be developers remaining on surfaces of the photoreceptor drums 24K, 24Y, 24M, 24C. Such residual developers respectively reach cleaning parts 30K, 30Y, 30M, 30C along with the rotations of the photoreceptor drums 24K, 24Y, 24M, 24C and are removed.

Next, configurations and operations of the cleaning parts (cleaning devices) 30K, 30Y, 30M, 30C of the present embodiment are described.

Figure 2:
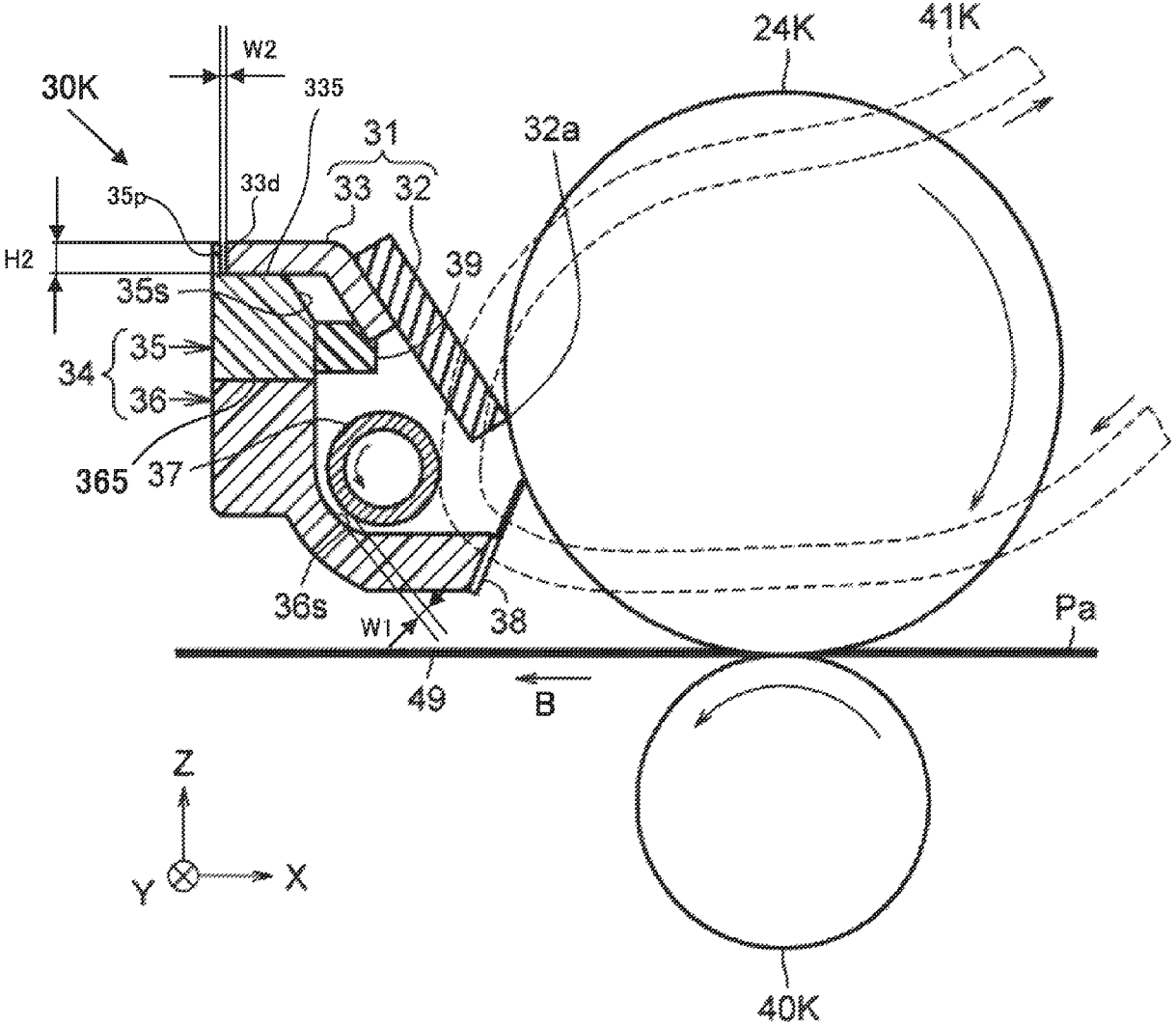
FIG. 2 illustrates a cross-sectional view of a schematic configuration of a cleaning part 30K in an image forming unit of the first embodiment.

FIG. 2 illustrates a cross-sectional view of a schematic configuration of the cleaning part 30K in the image forming unit 20K of the present embodiment. As illustrated in FIG. 2, the cleaning part 30K has a cleaning member (blade unit) 31 removing the residual developer on the photoreceptor drum 24K from the photoreceptor drum 24, a spiral-shaped rotary conveying member 37 conveying the removed residual developer to a vicinity of one end of the photoreceptor drum 24K in the longitudinal direction, and a housing 34 containing the rotary conveying member 37. The housing 34 is configured with a support member 35 and a protective member 36 that are fixed to each other. In FIG. 2, direction B (negative X direction) in which the recording medium Pa is carried is defined as a medium carrying direction.

Figure 3:
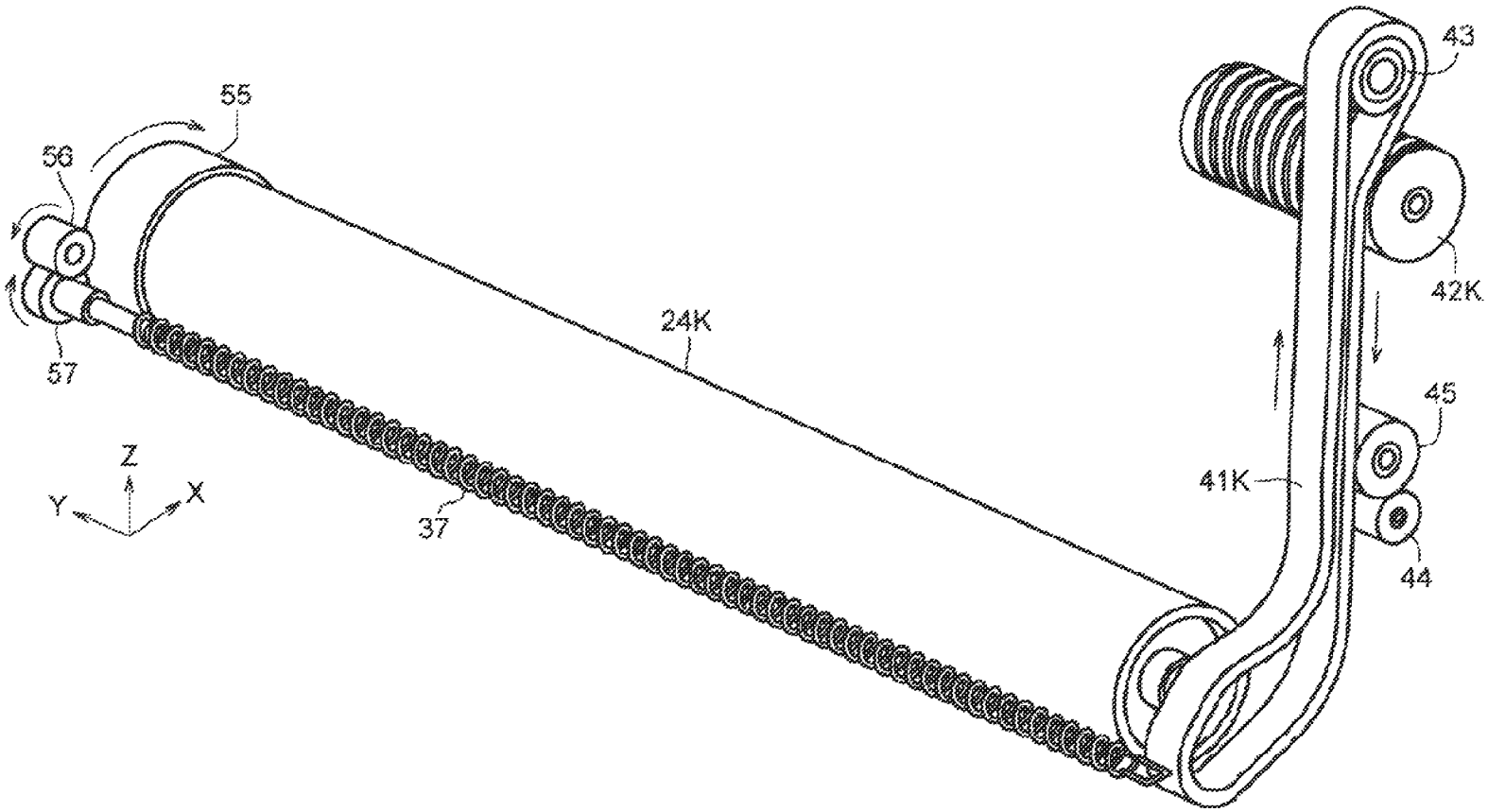
FIG. 3 illustrates a perspective view of an example of a rotary conveying member of the first embodiment and peripheral members thereof.

FIG. 3 illustrates a perspective view of an example of the rotary conveying member 37 of the present embodiment and peripheral members thereof. As illustrated in FIG. 3, the rotary conveying member 37 is made of a wire that spirally extends in the Y-axis direction along the surface of the photoreceptor drum 24K. When the rotary conveying member 37 rotates about its own rotation axis, an inclined curved surface of the spiral-shaped wire functions as an action surface pushing the developer toward the −Y-axis direction. Therefore, while rotating about the rotation axis inside the housing 34, the rotary conveying member 37 can convey the removed residual developer to the vicinity of the one end of the photoreceptor drum 24K in the longitudinal direction.

As illustrated in FIG. 3, a base end portion of the rotary conveying member 37 is fixed on a transmission gear 57. An end portion of the photoreceptor drum 24K is fixed to a drive gear 55. The drive gear 55 rotates in response to a drive force transmitted from a power source (not illustrated in the drawings) such as a motor and thereby causing the photoreceptor drum 24K to rotate. An outer peripheral surface of an idle gear 56 is engaged with both the drive gear 55 and the transmission gear 57. Therefore, the transmission gear 57 rotates in response to a rotational drive force transmitted from the drive gear 55 via the idle gear 56. Therefore, the rotary conveying member 37 can rotate in the same circumferential direction as the photoreceptor drum 24K at a speed that is synchronized with a rotating speed of the photoreceptor drum 24K.

The rotary conveying member 37 can be prepared, for example, by spirally winding a metal wire around a core and then removing the core. As the wire, a hard steel wire (such as stainless steel) may be used. Further, with regard to dimensions of the rotary conveying member 37, for example, an outer diameter (spiral diameter) of the rotary conveying member 37 may be within a range of 5.4 mm-5.8 mm, and an outer diameter of the wire may be about 0.8 mm.

As illustrated in FIG. 2, the cleaning member 31 is configured with a cleaning blade 32 that scrapes off the residual developer from the photoreceptor drum 24K while being in slidable contact with the surface of the rotating photoreceptor drum 24K, and a metal blade support plate 33 that is fixed to the housing 34. The blade support plate 33 forms a base end portion of the cleaning member 31. The cleaning blade 32 is attached to the blade support plate 33 using an adhesive. The cleaning blade 32 is, for example, an elastic body made of a resin material such as urethane rubber. A front end portion (edge portion) 32*a* of the cleaning blade 32 needs to be in contact with the surface of the photoreceptor drum 24K at a certain angle and at a certain pressure. Further, in order to suppress wear of the surface of the photoreceptor drum 24K and efficiently remove the residual developer, it is desirable that variation in contact pressure between the cleaning blade 32 and the photoreceptor drum 24K be suppressed. In view of the above, it is required that the housing 34 supporting the cleaning member 31 have a high rigidity.

When the developer scraped off from the surface of the photoreceptor drum 24K moves inside the housing 34 to the rotary conveying member 37, as illustrated in FIG. 3, the rotary conveying member 37 rotates to convey the developer to a developer conveying belt 41K. The developer conveying belt 41K is a caterpillar-like elastic belt and is stretched around a roller 43 arranged at an upper position. A rotation drive gear 44 can cyclically move the developer conveying belt 41K in a direction as indicated by an arrow by applying a rotational drive force to the developer conveying belt 41K via an action gear 45. As a result, the developer conveying belt 41K can carry on its surface the developer conveyed thereto by the rotary conveying member 37 and convey the developer upward. The developer conveyed upward falls down to a surface of a developer recovery member 42K and is sent by the developer recovery member 42K into the waste developer containing part 23K (FIG. 1).

The developer recovery member 42K has a tubular shape and projects into interior of the waste developer containing part 23K (FIG. 1) from a through hole formed on a side frame (not illustrated in the drawings) of the image forming unit 20K. A spiral-shaped concave-convex portion is formed on the surface of the developer recovery member 42K. The spiral-shaped concave-convex portion can rotate about a rotation axis of the developer recovery member 42K and send the developer into the interior of the waste developer containing part 23K.

A projection part 35*p* is disposed on an upper surface of the support member 35 and at a most downstream side in the medium carrying direction B. The upper surface may be described as a farther surface from a path of the recording medium. The projection part 35*p* projects toward positive Z direction in FIG. 2. The projection height H2 is almost the same as the thickness of the blade support plate 33. Alternatively, the height H2 may be smaller than the thickness of the blade support plate 33. The projection part 35*p* functions to prevent the toner from leaking outside through an adhesive area 335 between the blade support plate 33 and the support member 35. The seal member 39 is disposed to primarily prevent the toner from entering the adhesive area 335. However, in a case where a crack occurs in the adhesive area 335, the toner is likely to enter the crack and might come out. The projection part 35*p* is disposed to stop such toner accidentally coming out through the adhesive area 335.

There is a space between the projection part 35*p* and the blade support plate 33. Specifically, the space with a width W2 is defined from the most downstream edge 33*d* of the blade support plate 33 to the most upstream edge of the projection part 35*p*. In the embodiment, the support member 35 is made of resin. When the support member 35 is heated or cooled, warps of the support member 35 in X or Z direction can be created along Y direction. If there is no space between the projection part 35*p* and the blade support plate 33 and the warp occurs, they may contact and the arraignment (angle, position, pressure to provide) of the cleaning blade 32 may become out of order.

As illustrated in FIG. 2, the housing 34 is configured with the support member 35 of high rigidity properly supporting the blade support plate 33, and the protective member 36 of low rigidity having an inner wall 36*s* that opposes outer periphery of the rotary conveying member 37 and partially covers the rotary conveying member 37. An inner wall 35*s* of the support member 35 does not oppose the rotary conveying member 37.

Further, in order to prevent the residual developer removed by the cleaning blade 32 from falling onto the transfer belt 49 through a gap between a lower end portion of the protective member 36 and the surface of the photoreceptor drum 24K, a film member 38 is fixed to the lower end portion of the protective member 36 using a double-sided adhesive tape. As a result, the transfer belt 49 and the recording medium Pa can be prevented from being contaminated, and efficiency of conveying the developer can also be improved.

Further, in order to prevent the removed residual developer from leaking out the housing 34, an elastic seal member 39 filling a gap between the inner wall 35*s* of the support member 35 and the blade support plate 33 is attached using a double-sided adhesive tape. An attachment position of the seal member 39 is above a seam 365 between the support member 35 and the protective member 36 and is sufficiently distanced from the rotary conveying member 37. Therefore, even when the rotary conveying member 37 vibrates and is upwardly displaced, the rotary conveying member 37 can be reliably prevented from coming into contact with the seal member 39.

In the embodiment, the support member 35 is made of resin. The blade support plate 33 is made of metal. Since thermal expansion rates of these materials are not the same (resin's expansion rate is generally grater than that of metal), warps of the support member 35 in X or Z direction can be created along Y direction with respect the blade support plate 33 when the temperature changes. Due to the warp of the support member 35, it is practically difficult to completely attach an entire surface of the support member 35 to an entire surface of the blade support plate 33 in Y direction. If the seal member 39 is not present, toner is likely to come out of the unit through a gap created by the warp when the unit lies. Specifically, when the surface of the unit in the negative X direction faces down, the toner will frequently come out through the gap.

Further, as illustrated in FIG. 2, the rotary conveying member 37 is arranged at a position close to the inner wall 36*s* of the protective member 36. When the gap (W1) between the rotary conveying member 37 and the inner wall 36*s* is too wide, the developer may stay or accumulate in the gap so that the efficiency of conveying the developer deteriorates. From a point of view of preventing this, it is desirable that the gap (W1) between the rotary conveying member 37 and the inner wall 36*s* be 0.5 mm or less.

On the other hand, since the gap (W1) between the rotary conveying member 37 and the protective member 36 is narrow, outer periphery of the rotating rotary conveying member 37 may come into contact with the inner wall 36*s* of the protective member 36. Conventionally, as disclosed in Patent Document 1, there is a problem that, due to contact with each other between the rotary conveying member and the inner wall of the housing, friction is generated and high frequency noise is generated. The conventional housing is a resin molded product integrally molded using a resin molding material and is required to have high rigidity in order to properly support a cleaning blade fixed to the housing. However, due to the high rigidity of the housing, there is a problem that, when the housing and the rotary conveying member come into contact with each other to generate friction, high frequency noise is generated.

In contrast, the housing 34 of the present embodiment is configured with two members, that is, the support member 35 of high rigidity properly supporting the cleaning member 31 and the protective member 36 of low rigidity covering the rotary conveying member 37. The protective member 36 has a lower rigidity and a lower dynamic friction coefficient than the support member 35. Therefore, even when the rotary conveying member 37 rubs against the protective member 36, generation of high frequency noise can be prevented. In addition, the support member 35 has a rigidity higher than that of the protective member 36 and thus can properly support the cleaning member 31.

The support member 35 can be prepared using a resin molding material to which a filler for rigidity reinforcement is added. As the resin molding material of the support member 35, for example, a thermosetting resin such as a modified polyphenylene ether (m-PPE) resin may be used. As the filler, for example, an inorganic filler of which glass fiber is a main component may be added. The filler's amount in the support member 35 is preferably within 10 to 50%. When the support member 35 is prepared using the m-PPE resin and glass fiber of an additive rate of 20%, as the rigidity of the support member 35, a bending strength of about 107 MPa based on a measurement method in accordance with "ASTM D790" can be realized.

On the other hand, it is desirable that the protective member 36 be prepared using a resin molding material to which a filler is not added. As the resin molding material of the protective member 36, for example, a thermoplastic resin such as an ABS resin may be used. When the protective member 36 is prepared using the ABS resin, as the rigidity of the protective member 36, a bending strength of about 75 MPa based on a measurement method in accordance with "ASTM D790" can be realized. The filler reinforces rigidity of a resin molded product. On the other hand, the filler is exposed from a surface of the resin molded product. Therefore, the surface has a rough concave-convex surface. Therefore, when the rotary conveying member 37 made of metal rubs against the surface of the resin molded product of this kind, high frequency noise unpleasant to hear is generated. The protective member 36 of the present embodiment does not contain the filler and has low rigidity. Therefore, the generation of this kind high frequency noise can be avoided.

It is preferred that the rigidity of the support member 35 is more than 100 MPa, and the rigidity of the protective member 36 is less than 80 MPa based on the measurement method in accordance with ASTM D790. Also, it is noted that the gap between rigidities of the support member 35 and protective member 36 is preferably 20 MPa or more. The ASTM is a worldwide standard which is formerly known as the American Society for Testing and Materials.

Figure 4:
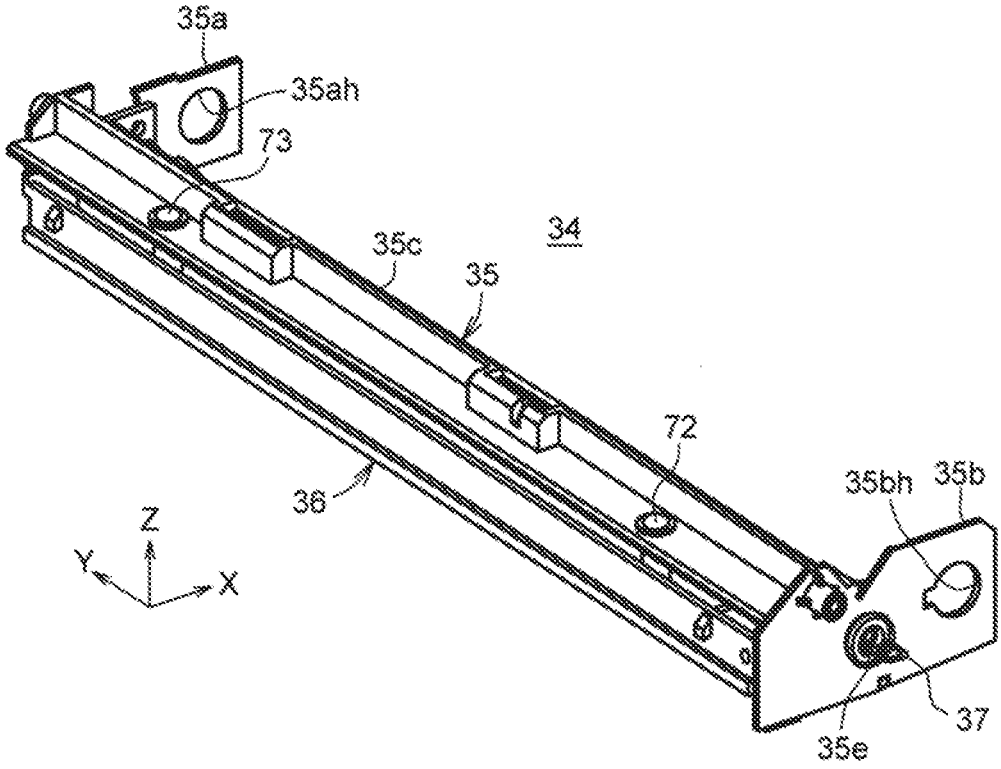
FIG. 4 illustrates a perspective view of a specific example of a housing of the first embodiment.
Figure 5A:
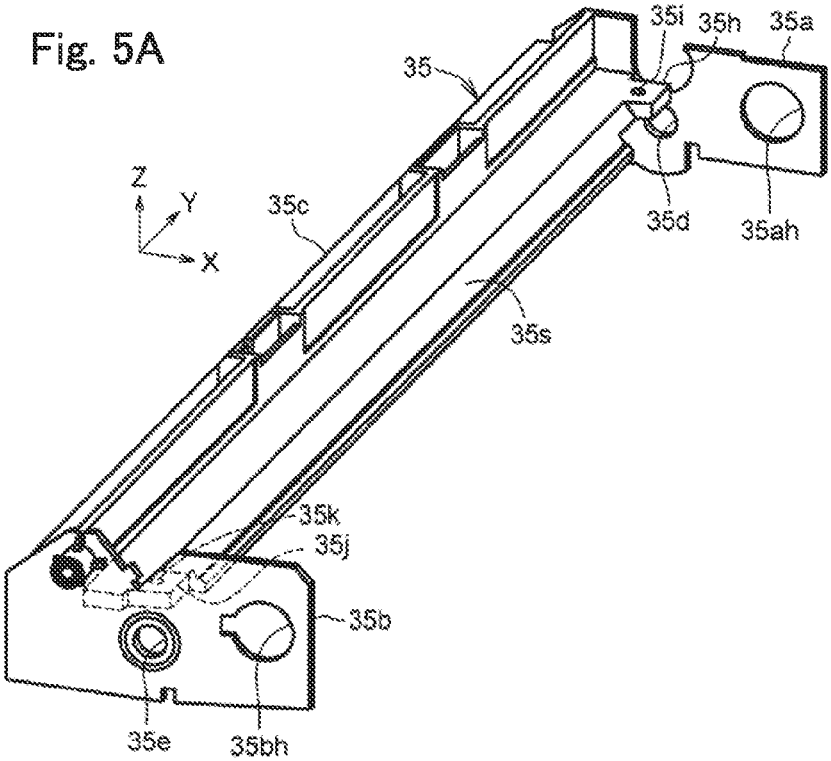
FIG. 5A illustrates a perspective view of a support member in a state in which a cleaning member is not installed.
Figure 5B:
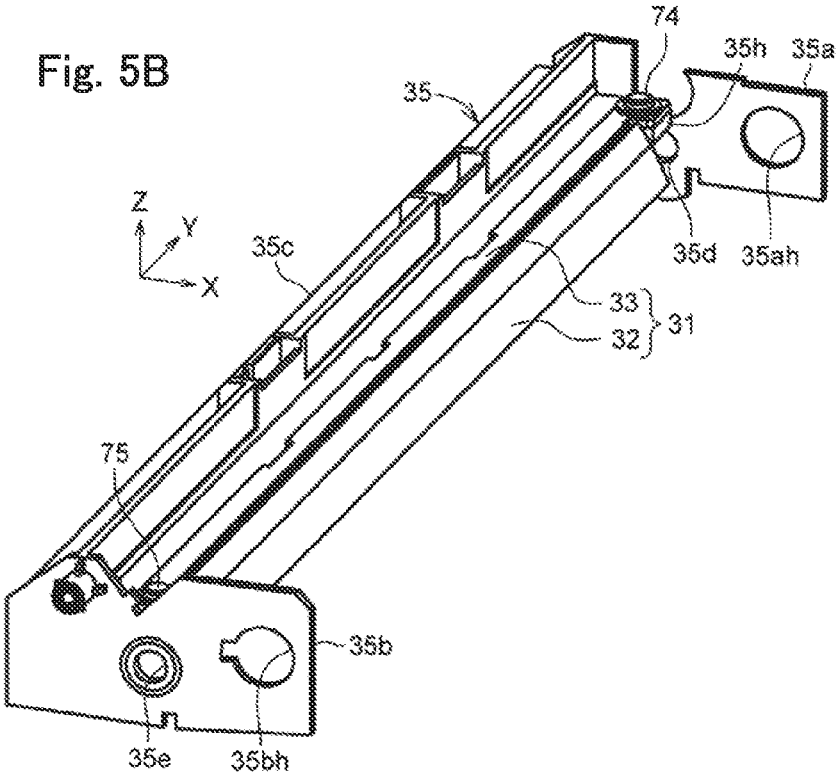
FIG. 5B illustrates a perspective view of the support member in a state in which the cleaning member is installed.

FIG. 4 illustrates a perspective view of a specific example of the housing 34 containing the rotary conveying member 37. FIG. 5A illustrates a perspective view of the support member 35 of FIG. 4 in which the cleaning member 31 is not installed; and FIG. 5B illustrates a perspective view of the support member 35 in which the cleaning member 31 is installed. Further, FIG. 6 illustrates a perspective view of the protective member 36 of FIG. 4 alone.

As illustrated in FIG. 5A, the support member 35 is a resin molded product having a main body part 35*c*, and side plate parts 35*a*, 35*b* that respectively project from both end portions of the main body part 35*c* in a longitudinal direction. Through holes 35*ah*, 35*bh* are respectively formed on the side plate parts 35*a*, 35*b* allowing two end portions of the photoreceptor drum 24K in the longitudinal direction to be respectively inserted thereto. The main body part 35*c* has insertion holes 35*e*, 35*d* that respectively allow two end portions of the rotary conveying member 37 in the longitudinal direction to be inserted thereto, and mounting parts 35*h*, 35*j* for mounting the cleaning member 31. Attaching holes 35*i*, 35*k* are respectively formed on the mounting parts 35*h*, 35*j*.

As illustrated in FIG. 5B, the cleaning member 31 is installed on the support member 35 using fastening members 74, 75 that are screw members. In the state in which the cleaning member 31 is installed, two end portions of the cleaning member 31 are mounted on the mounting parts 35*h*, 35*j* of the support member 35. Shaft portions of the fastening members 74, 75 are respectively inserted through the two end portions of the cleaning member 31 and screwed to attaching holes 35*i*, 35*k* of the support member. Heads of the fastening members 74, 75 respectively cause the cleaning member 31 to abut on the mounting parts 35*h*, 35*j* of the support member 35. In this way, the cleaning member 31 can be fixed on the support member 35 using the fastening members 74, 75.

Figure 6:
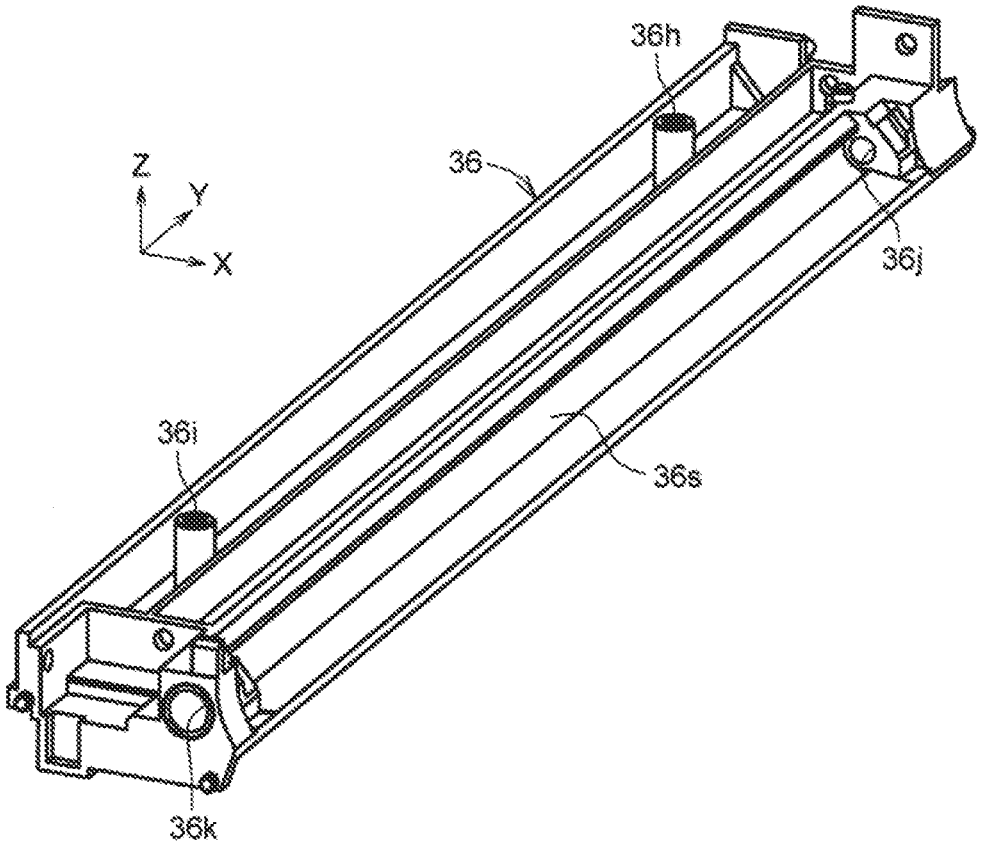
FIG. 6 illustrates a perspective view of a protective member of FIG. 4 alone.

On the other hand, as illustrated in FIG. 6, the protective member 36 is a resin molded product having the inner wall 36*s* for covering the outer periphery of the rotary conveying member 37, and insertion holes 36*j*, 36*k* for allowing the two ends of the rotary conveying member 37 to be respectively inserted thereto. Attaching holes 36*h*, 36*i* are formed on the protective member 36.

The protective member 36 of FIG. 6 and the support member 35 of FIG. 5B are bonded together by using fastening members 72, 73 (FIG. 4) that are screw members. Specifically, the support member 35 and the protective member 36 are superimposed in such a way that the insertion holes 36*j*, 36*k* of the protective member 36 of FIG. 6 and the insertion holes 35*e*, 35*d* of the support member 35 of FIG. 5B are coaxially arranged. Next, shaft portions of the fastening members 72, 73 are screwed to the attaching holes 36*h*, 36*i* of the protective member 36 via insertion holes (not illustrated in the drawings) of the support member 35, and thereby the housing 34 of FIG. 4 can be configured. Further, the rotary conveying member 37 is inserted into the insertion holes 36*j*, 36*k*, 35*e*, 35*d* of the protective member 36 and the support member 35 and is supported.

In the above, the cleaning part 30K of the image forming unit 20K is described. Configurations of cleaning parts 30Y, 30M, 30C of the other image forming units 20Y, 20M, 20C are the same as the configuration of the cleaning part 30K of the image forming unit 20K and thus their detailed description is omitted.

Further, also in the image forming units 20Y, 20M, 20C, developer conveying belts 41Y, 41M, 41C convey upward used developer recovered by the cleaning parts 30Y, 30M, 30C. Further, developer recovery members 42Y, 42M, 42C can respectively send the used developer conveyed upward by the developer conveying belts 41Y, 41M, 41C into interiors of waste developer containing parts 23Y, 23M, 23C. Configurations of the developer conveying belts 41Y, 41M, 41C and their drive mechanism are the same as the configuration of the above-described developer conveying belt 41K and its drive mechanism. Configurations of the developer recovery members 42Y, 42M, 42C are also the same as the configuration of the above-described developer recovery member 42K.

As described above, in the cleaning parts 30K, 30Y, 30M, 30C of the present embodiment, as illustrated in FIG. 2, the housing 34 that houses the rotary conveying member 37 is configured with two members, the support member 35 of high rigidity and the protective member 36 of low rigidity. The support member 35 does not come in contact with the rotary conveying member 37. The protective member 36 that may come in contact with the rotary conveying member 37 has a rigidity lower than that of the support member 35. Therefore, even when the rotary conveying member 37 rubs against the protective member 36, generation of high frequency noise can be prevented. In addition, the support member 35 has a rigidity higher than that of the protective member 36 and thus can properly support the cleaning member 31. Therefore, it is possible to suppress generation of high frequency noise unpleasant to hear and to realize high cleaning performance.

Further, since the housing 34 of the present embodiment has the above-described configuration, there is an advantage that the housing 34 has high durability.

In the above embodiment, the toner images formed on the photoreceptor drums (24K to 24C) are directly transferred to the recording medium Pa that is conveyed on the transfer belt 49. However, the invention may use an intermediate transfer member (belt or drum). In such an embodiment, a toner image formed on a photoreceptor drum is primarily transferred to the surface of the intermediate transfer member. Secondarily, the transferred toner image on the intermediate transfer member is transferred to a recording medium on a transfer belt. Regarding features and structure of the intermediate transfer member, the application is incorporated with U.S. Pat. No. 8,509,648.

Second Embodiment

Next, a second embodiment according to the present invention is described. A configuration of an image forming apparatus of the second embodiment is the same as the configuration of the image forming apparatus 1 (FIG. 1) of the first embodiment except a part of a configuration of a housing of a cleaning part that removes residual developer from the photoreceptor drum 24K, 24Y, 24M, 24C.

Figure 7:
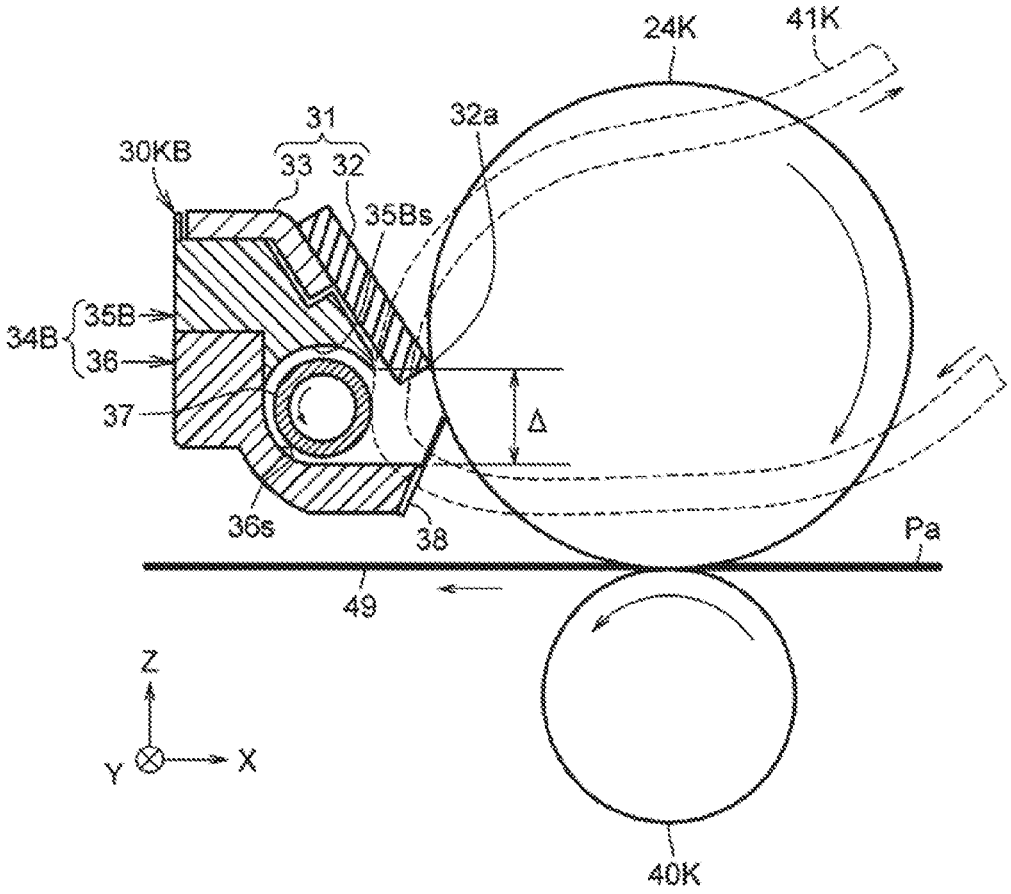
FIG. 7 illustrates of cross-sectional view of a schematic configuration of a cleaning part of a second embodiment according to the present invention.

FIG. 7 illustrates of cross-sectional view of a schematic configuration of a cleaning part 30KB of the second embodiment. The cleaning part 30KB can remove residual developer from the photoreceptor drum 24K. Configurations of cleaning parts removing residual developer from the photoreceptor drums 24Y, 24M, 24C are also the same as the configuration of the cleaning part 30KB of FIG. 7.

The cleaning part 30KB has the cleaning member 31 removing residual developer on the photoreceptor drum 24K from the photoreceptor drum 24K, the rotary conveying member 37 conveying the removed residual developer to the vicinity of one end of the photoreceptor drum 24K in the longitudinal direction, and the housing 34B housing the rotary conveying member 37. The housing 34B is configured with a support member 35B of high rigidity properly supporting the blade support plate 33 and the protective member 36 of low rigidity. The configuration of the protective member 36 of FIG. 7 is the same as the configuration of the protective member 36 (FIG. 2) of the above-described first embodiment. Similar to the support member 35 of the first embodiment, the support member 35B is prepared using a resin molding material to which a filler for rigidity reinforcement is added.

The support member 35B of the present embodiment has an inner wall 35Bs opposing the outer periphery of the rotary conveying member 37. The inner wall 35Bs covers the outer periphery of the rotary conveying member 37. It is in this point that the support member 35B is structurally different from the support member 35 of the first embodiment.

A gap D between the inner wall 35Bs of the support member 35B and the outer periphery of the rotary conveying member 37 is larger than a gap d between the inner wall 36*s* of the protective member 36 and the outer periphery of the rotary conveying member 37. Further, it is desirable the gap D be adjusted to a gap (for example, about 1 mm) that does not allow the inner wall 35Bs and the rotary conveying member 37 to easily come into contact with each other. Further, as illustrated in FIG. 7, a diameter A of an opening of the housing 34B is smaller than an outer diameter (diameter dimension) of the rotary conveying member 37. Therefore, the housing 34B has a structure that is easy to take in developer scraped off from the photoreceptor drum 24K. Therefore, the efficiency of conveying the developer by the rotary conveying member 37 can be improved.

Further, a front end portion of the support member 35B is interposed between the cleaning blade 32 and the rotary conveying member 37. Therefore, even when the rotary conveying member 37 vibrates and is displaced toward a cleaning blade 32 side, the rotary conveying member 37 and the cleaning blade 32 can be reliably prevented from coming into contact with each other.

Further, in the above-described first embodiment, in order to prevent the removed residual developer from leaking out the housing 34, as illustrated in FIG. 2, the seal member 39 is attached between the inner wall 35*s* of the support member 35 and the cleaning member 31. In contrast, the front end portion of the support member 35B of the present embodiment extends to a vicinity of the cleaning blade 32. Therefore, there is an advantage that it is not necessary to provide the seal member 39.

In the above, various embodiments according to the present invention are described with reference to the drawings. However, these embodiments are examples of the present invention, and various embodiments other than the above can also be adopted. For example, as illustrated in FIG. 4, the support member 35 and the protective member 36 of the above first embodiment are bonded using the fastening members 72, 73. However, the present invention is not limited to this. The support member 35 and the protective member 36 may also be bonded to each other using an adhesive. The same applies to the bonding between the support member 35B and the protective member 36 of the second embodiment.

The present invention can be applied to a printer. However, the present invention is not limited to a printer, but can also be applied to a copier, a facsimile device or a multifunctional peripheral (MFP). The MFP is an image forming apparatus that is combinedly equipped with functions of a plurality of devices including such devices as a copier, a printer, an image scanner and a facsimile device.

What is claimed is:

1. A cleaning device incorporated in an image forming apparatus, the image forming apparatus comprising an image carrier and a transfer member, the image carrier carrying a developer image formed by an electrophotographic method, the transfer member transferring the developer image from the image carrier to a medium, the cleaning device comprising:

a cleaning member that removes, from the image carrier, residual developer that remains on the image carrier without being transferred from the image carrier to the medium;

a rotary conveying member that has a rotation axis in a predetermined direction, rotates about the rotation axis, and conveys the removed residual developer in the predetermined direction; and a housing that contains the rotary conveying member, the housing comprising:

a support member that supports the cleaning member; and a protective member that has an inner wall which opposes outer periphery of the rotary conveying member and partially covers the rotary conveying member, wherein the protective member is made of a resin molding material to which filler is not added, the support member is made of a resin molding material to which filler is added, wherein the filler is inorganic filler of which glass fiber is a main component.

2. The cleaning device according to claim 1, wherein the cleaning member comprises:

a front end portion that scrapes off the residual developer from the image carrier while being in slidable contact with a surface of the image carrier, and a base end portion that is fixed on the support member.

3. The cleaning device according to claim 1, wherein the support member comprises an inner wall which opposes the outer periphery of the rotary conveying member and partially covers the rotary conveying member.

4. The cleaning device according to claim 1, wherein a gap between the rotary conveying member and the inner wall of the protective member is 0.5 mm or less.

5. The cleaning device according to claim 1, wherein the cleaning member comprises a cleaning blade that scrapes off the residual developer, and a blade support plate that is fixed to the housing and supports the cleaning blade.

6. The cleaning device according to claim 1, wherein the rotary conveying member spirally extends along the rotation axis.

7. The cleaning device according to claim 1, wherein a rigidity of the protective member is lower than a rigidity of the support member.

8. The cleaning device according to claim 2, further comprising:

a seal member that is interposed between the base end portion of the cleaning member and an inner wall of the support member.

9. The cleaning device according to claim 3, wherein the housing has an opening in a vicinity of the front end portion of the cleaning member, and a diameter of the opening is smaller than an outer diameter of the rotary conveying member.

10. The cleaning device according to claim 5, wherein the support member includes a projection part that projects toward a direction substantially perpendicular to a medium carrying direction at an end portion in the medium carrying direction, and wherein the support member faces a side surface of the blade support plate.

11. The cleaning device according to claim 10, wherein the projection part faces the side surface of the blade support plate with a predetermined space.

12. An image forming unit incorporated in an image forming apparatus, the image forming unit comprising:

a developer containing part that supply developer;

an image carrier that carries an electrostatic latent image formed by an electrophotographic method;

a developer carrier that carries the developer supplied from the developer containing part and attaches the developer to the electrostatic latent image to form the developer image on the image carrier; and a cleaning device according to claim 1.

13. The image forming unit according to claim 12, wherein the rotary conveying member spirally extends along the rotation axis.

14. An image forming apparatus, comprising:

a developer containing part that supply developer;

an image carrier that carries an electrostatic latent image formed by an electrophotographic method;

a developer carrier that carries the developer supplied from the developer containing part and attaches the developer to the electrostatic latent image to form a developer image on the image carrier; and a cleaning device according to claim 1.

15. The image forming apparatus according to claim 14, wherein the rotary conveying member spirally extends along the rotation axis.

16. A cleaning device incorporated in an image forming apparatus, the image forming apparatus comprising an image carrier, the image carrier carrying a developer image formed by an electrophotographic method, the cleaning device comprising:

a cleaning member that removes developer from the image carrier;

a rotary conveying member that rotates and conveys removed developer in a predetermined direction;

a first support member that supports the cleaning member;

a housing that contains the rotary conveying member, the housing comprising:

a second support member that supports the first support member; and a protective member that has an inner wall which opposes an outer periphery of the rotary conveying member, wherein the protective member has a rigidity lower than the second support member has.

17. The cleaning device according to claim 16, wherein a length between the inner wall of the protective member and the outer periphery of the rotary conveying member is shorter than a length between the outer periphery of the rotary conveying member and a side surface of the rotary conveying member side of the second support member.

* * * * *